US008319440B2

(12) United States Patent
Schenk et al.

(10) Patent No.: US 8,319,440 B2
(45) Date of Patent: Nov. 27, 2012

(54) DIRECTION CONTROLLABLE LIGHTING UNIT

(75) Inventors: Tim C. W. Schenk, Eindhoven (NL); Lorenzo Feri, Eindhoven (NL); Hongming Yang, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 320 days.

(21) Appl. No.: 12/664,083

(22) PCT Filed: Jun. 13, 2008

(86) PCT No.: PCT/IB2008/052341

§ 371 (c)(1),
(2), (4) Date: Dec. 11, 2009

(87) PCT Pub. No.: WO2008/155697

PCT Pub. Date: Dec. 24, 2008

(65) Prior Publication Data

US 2010/0176732 A1 Jul. 15, 2010

(30) Foreign Application Priority Data

Jun. 18, 2007 (EP) ..... 07110485

(51) Int. Cl.
*H05B 37/02* (2006.01)
*H05B 37/00* (2006.01)

(52) U.S. Cl. ..... 315/152; 315/151; 315/158; 315/291; 315/312

(58) Field of Classification Search ..... 315/151, 315/152, 158, 291, 312; 340/310.11, 310.12
See application file for complete search history.

(56) References Cited

U.S. PATENT DOCUMENTS

| | | | | |
|---|---|---|---|---|
| 4,918,297 | A * | 4/1990 | Kurimoto | 235/383 |
| 5,345,072 | A * | 9/1994 | Hayashi et al. | 250/201.5 |
| 5,500,639 | A * | 3/1996 | Walley et al. | 340/539.19 |
| 5,864,525 | A * | 1/1999 | Takeshita et al. | 369/44.23 |
| 6,079,862 | A * | 6/2000 | Kawashima et al. | 382/103 |
| 7,004,603 | B2 * | 2/2006 | Knight | 362/249.03 |
| 7,221,271 | B2 * | 5/2007 | Reime | 340/541 |
| 2006/0044800 | A1 * | 3/2006 | Reime | 362/276 |
| 2006/0056855 | A1 | 3/2006 | Nakagawa et al. | |
| 2007/0031149 | A1 | 2/2007 | Sasai et al. | |
| 2008/0185969 | A1 * | 8/2008 | Vegter et al. | 315/158 |

(Continued)

FOREIGN PATENT DOCUMENTS

DE 102005036275 A1 8/2007

(Continued)

*Primary Examiner* — Douglas W Owens
*Assistant Examiner* — Thai Pham
(74) *Attorney, Agent, or Firm* — Mark L. Beloborodov

(57) ABSTRACT

A direction controllable lighting unit (10) and use thereof in a lighting system (40) are described. A lighting unit (10) has means (16) for directing the light emission (22) into different directions. A plurality of light sources (20*a*, 20*b*) are mounted on a common body (14). The light sources (20*a*, 20*b*) are disposed to emit directed light into different directions. The light is modulated to contain identification codes 'A', 'B', which are unique. Within the lighting system (40), an optical sensor (46) is arranged in a region illuminated by the lighting unit (10). The optical sensor (46) demodulates the received light according to the identification code. A control unit (44) is connected to the optical sensor (46) and to the lighting unit (10) to control the direction of the lighting unit (10) based on information from the optical sensor (46).

5 Claims, 5 Drawing Sheets

U.S. PATENT DOCUMENTS

2008/0203928 A1 * 8/2008 Frumau et al. ..... 315/151

FOREIGN PATENT DOCUMENTS

JP 2006216397 A * 8/2006
WO 9955122 A1 10/1999
WO 2005012164 A1 2/2005
WO 2006111927 A1 10/2006
WO 2006111930 A2 10/2006
WO 2006111934 A1 10/2006
WO WO 2006111927 A1 * 10/2006
WO WO 2006111930 A2 * 10/2006
WO 2007052197 A1 5/2007

* cited by examiner

DIRECTION CONTROLLABLE LIGHTING UNIT

FIELD OF THE INVENTION

The present invention relates to lighting units and control thereof, and more specifically to a direction controllable lighting unit, a controllable lighting system comprising at least one direction controllable lighting unit and a method for controlling a lighting system with at least one direction controllable lighting unit.

BACKGROUND OF THE INVENTION

Direction controllable lighting units are known and used e.g. in lighting for entertainment purposes, such as in nightclubs and theatres. In the present context, the term "direction controllable" will be used to refer to lighting units which have a directed light emission, i.e. that has a specific direction as opposed to isotropic light emission (e.g. spot lights), where the direction of this light emission is automatically (non-manually) controllable, e.g. by a motorized movement of a lamp body comprising at least one light source, which results in a change of direction of the light emission.

WO 99/55122 relates to a lighting system including robotic lamps which may be remotely controlled by commands according to the DMX standard. In this way, parameters of a direction controllable lamp, such as coordinates for the X, Y and Z axes, pitch, yaw and roll angles may be controlled. The lamps orientation is sensed by sensors, e.g. pan/tilt motors may be equipped with shaft encoders which yield digital outputs of the actual pan/tilt angles. This allows for closed-loop control of the light emission direction, which may be used for 3D positioning tasks in real time.

SUMMARY OF THE INVENTION

It is an object of the present invention to provide a direction controllable lighting unit which facilitates directional control, especially automatic directional control.

This object is solved by a direction controllable lighting unit according to various aspects and embodiments of the invention.

The inventors have recognized that prior direction controllable lighting units and control systems provide little information which may suitably be used for automatic directional control. Therefore, it is a basic idea of the invention to provide a lighting unit which emits light that comprises basic information about the direction of the light emission. This should, however, not impair the lighting unit's basic operation and lighting purpose, but be detectable for a suitable sensing device.

The lighting unit according to the invention is direction controllable, and therefore comprises means for directing the light emission into different directions. As will become apparent in the following detailed description, such light directing means may be understood broadly to cover any means suited to change the light emission direction, e. g. to change the angle of an optical axis defined as the center of intensity of the emitted light bundle or beam. Such means include mechanical means (e. g. a motor for a light source fixture), optical (e. g. rotatable orientation of a lens) as well as electrical means (e. g. using voltage sensitive optical devices). Further, in accordance with a preferred aspect of the invention, a direction controllable lighting unit may also comprise a plurality of light sources facing into different, fixed directions and a corresponding driving means for controlling these light sources to vary the relative intensity and thereby influence the direction of the resulting summarized light emission.

Further, according to aspects and embodiments of the invention, there are provided at the lighting unit a plurality of light sources disposed to emit directed light emissions. These light emissions are different, i. e. their spatial intensity distribution differs. Specifically, the light emissions differ in at least one of shape (e. g. narrow beam/wide beam), direction (i. e. angle of central optical axis) or position (e. g. parallel directions but distance between optical axes). Each of said light sources, of which at least two are present, has associated coding means driving the light source in a way such that light emitted from the light source is modulated to contain an identification code. The identification code is chosen such that it is different between at least the two light sources of the lighting unit, and preferably unique among all modulated light sources of the lighting unit, and most preferably even unique among all light sources in a lighting system comprising multiple modulated light sources together within a common optical range.

By providing such modulated identification codes, the light emitted from the light sources becomes distinguishable to a suitable observer, i. e. an optical sensor with the ability to demodulate the received light. Since the light sources are mounted to emit light with different spatial distribution, the information about which light beam (I. e. from which light source) an observer receives contains information about the direction of the direction controllable lighting unit relative to the observer.

The spatial distribution of the light emission of the modulated light sources may be different in shape or position. The difference should of course be detectable as different intensities by a suitable sensor positioned at a location where the light emissions overlap. However, to gain additional information about the relative orientation of the direction controllable lighting unit and an observer, it is preferred that they are oriented in different directions.

In a simple example, if a lighting unit has a first light source pointing to the right, and a second light source pointing to the left, an observer identifying received light as coming from the first light source can gather from this the information that the lighting unit is pointed to his left. In case the observer simultaneously receives light emission from both light sources, a comparison of received intensities of light may yield information if the lighting unit is pointed directly towards the observer (such that light from both light sources is received at the same intensity), or if an offset remains.

Therefore, a lighting unit according to the invention may greatly facilitate any type of control task related to automatically controlling the direction of the lighting unit.

It should be emphasized that in the present context the term "light source" is used for any device emitting light to the outside of the lighting unit. Thus, a central light emitter with e. g. two different optical systems (e. g. lenses etc.) which each provide a separate light beam are regarded as two light sources. Further, the emission direction of each light source of course does not relate to the light emitting element alone, e. g. an electrical arc, but to the whole optical system used for generating a directed beam, such as reflector, lenses, blinds etc.

There are various preferred, optional aspects of the invention. The light sources emitting modulated light may preferable be LEDs, which are well suited for modulation. The modulated light sources may emit visible light, which may contribute to or even constitute the complete light output of the lighting unit used for lighting purposes. The modulated light sources may be about equal in intensity and/or light emission shape, but it is alternatively also possible to have different modulated light sources, such as a very bright main light source (e. g. HID) and an auxiliary light source of lower intensity, e. g. LED.

It is alternatively also possible that the lighting unit comprises further light sources, which may or may not be modulated. This further light source, or further light sources, may be LED, but could also be any type of lamp used in conventional lighting, such as incandescent lamp, discharge lamp, fluorescent lamp etc. According to a preferred aspect of the invention, at least one main light source of relatively high electrical power (and corresponding high light output) is provided, whereas the modulated light sources only have a lower electrical power (and lower light output). The main light source may be modulated also. The light emitted from the modulated light sources may even be infrared light, so that these do not contribute to the emitted visible light from the lighting unit at all.

In a further preferred aspect of the invention, the modulated light sources are arranged such that their directions are evenly distributed over an emission angle (which may be an angle in a plane as well as a solid angle). In case of a main light source of high power, it is preferred for the auxiliary light sources to be evenly distributed around the beam direction of the main light source.

According to a further preferred embodiment of the invention, the direction controllable light source forms part of a controllable lighting system. There is further provided an optical sensor which may be arranged in a region to be illuminated by the lighting unit. The optical sensor is preferably a portable, e. g. handheld device. The optical sensor comprises demodulation means to demodulate the identification codes, such that identification codes from different light sources may be distinguished.

Further, control means are provided with some type of connection (e. g. cable, such as direct control connections or powerline, as well as wireless, such as radio or infrared) both to the optical sensor and to the lighting unit. The control means automatically controls the direction of the lighting unit (by driving its directing means over the connection) based on information received from the optical sensor.

According to a further preferred aspect, the control means determines the relative positioning of the light emission direction of the lighting unit and the optical sensor. The relative positioning is determined by identifying, from the demodulated identification code, from which of the lighting sources light is received. Preferably, the light from the at least two modulated sources is distinguished by its code and further direction information is gathered from it. This could mean, e. g., to have a direction sensitive optical sensor and to gather the further information about each of the light emissions from which direction they are perceived. Also, the further information could be gathered by comparing the modulated light received, e. g. by the phase of the modulation code contained, to estimate the relative angle. It is especially preferred for the sensor to provide a measurement of intensity of light, and to identify a level of intensity of modulated light portions. In this case, relative positioning may be determined by identifying from which of the modulated light sources a higher intensity is received. It should, of course, be noted that in processing of the intensity measurement it may be preferable to observe the path loss, rather than absolute values of intensity, especially if it is known a priori that the different modulated light sources have different output power.

According to a further preferred embodiment of the invention, the control means controls the direction of the lighting unit in a closed-loop operation, of which at least one turn is completed. In each turn, the lighting unit is driven to change the direction, and then a measurement of the optical sensor is evaluated according to an evaluation criteria. For example, if it is desired that the lighting unit should point directly at the location of the optical sensor, a necessary change of direction may be derived from the available information about misalignment of lighting unit and sensor obtained as explained above. An evaluation criteria in this case may be a desired minimum intensity of received light from the lighting unit, a preferred quotient (e. g. close to 1) of the relative intensities of light received from the modulated light sources, or any other criteria suited for an iterative optimization procedure.

BRIEF DESCRIPTION OF THE DRAWINGS

In the following, preferred embodiments of the invention will be described with reference to the drawings, in which.

DETAILED DESCRIPTION OF EMBODIMENTS

Figure 1:
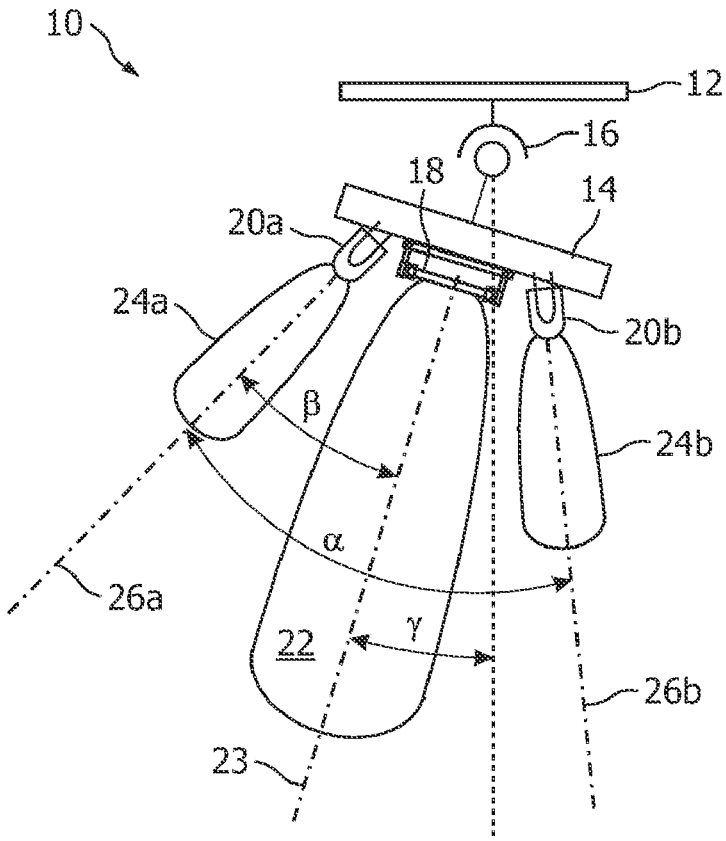
FIG. 1 shows a schematical side view of a first embodiment of a direction controllable lamp.

FIG. 1 shows in a side view a first embodiment of a direction controllable lighting unit (luminary) 10. A lighting unit comprises a mounting part 12 and a fixture 14 which is movable relative to the mounting part 12 in a motor-driven joint 16.

The fixture 14 carries light sources, which in the present example comprise a main light source 18 and auxiliary light sources 20*a*, 20*b*. The main light source 18 emits a directed beam of light 22 (spot light) around a central optical axis 23, the directional distribution (solid angle) of which is achieved by a suitable reflector (not shown). The auxiliary light sources are arranged at the fixture 14 to transmit directed light beams 24*a*, 24*b* with central optical axes 26*a*, 26*b*. The light emission 24*a*, 24*b* of the auxiliary light sources 20*a*, 20*b* differs in spatial intensity distribution. In the shown preferred example, it differs in emission direction, i.e. the optical axes 26*a*, 26*b* are arranged at an angle $\alpha$. Also, the light emission 24*a*, 24*b* of the auxiliary light sources 20*a*, 20*b* differs from the direction of light emission 22 from the main light source 18, i.e. there is an angle $\beta$ between the optical axes 26*a*, 26*b* of the auxiliary light sources 20*a*, 20*b* light emission and the central optical axis 23 of the main light sources' 18 light emission 22.

Alternatively, it would also be possible that auxiliary light sources 20*a*, 20*b* are arranged at a distance as shown, but emit light into parallel directions. As a further alternative, the emissions could be in the same direction, even with a common optical axis, if they have different shape, e.g. a first, broad beam and a second, narrow beam.

It should be noted that the controllable lighting unit 10 shown here is only represented schematically. The motor-driven joint 16 is not shown in detail. Different kinds of motor-driven movable mounting of lighting units are known per se to the skilled person.

Also, in FIG. 1 auxiliary light sources 20*a*, 20*b* are represented as LEDs, whereas the main light source 18 is represented as an incandescent halogen lamp. It should noted that this representation is by way of example only, and that especially the type of the main light source 18 may be chosen quite differently among available light sources, such as incandescent lamps, arc discharge lamps, fluorescent lamps and high power LEDs, as long as they are suited for lighting purposes, i.e. provide visible light at an intensity high enough to illuminate a certain area, e.g. parts of a room. Also, there may be multiple light sources provided as main light source(s), such as e.g. an array of LEDs, multiple incandescent lamps or even combinations of different types of light sources.

Figure 5:
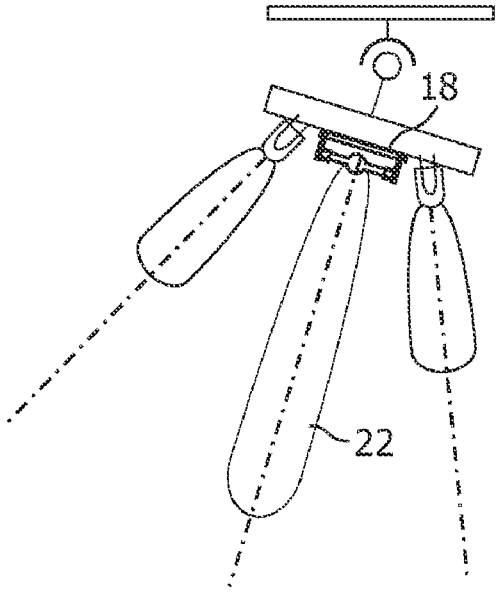
FIG. 5 shows a schematic side view of a third embodiment of a direction controllable lamp.
Figure 6:
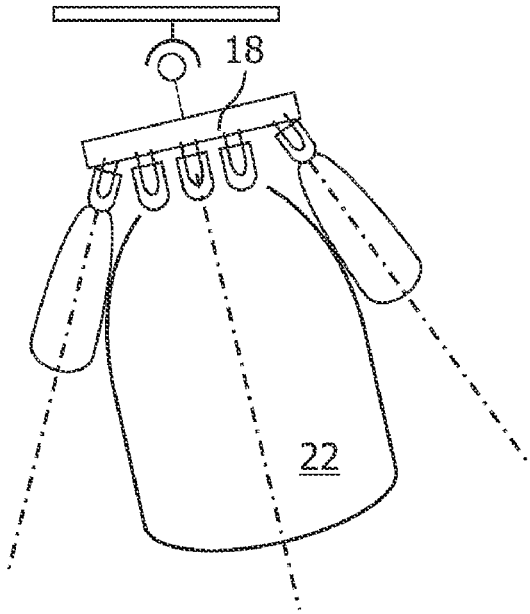
FIG. 6 shows a schematic side view of a second embodiment of a direction controllable lamp.

To illustrate this, further embodiments of lighting units are shown in FIG. 5, FIG. 6. FIG. 5 shows a second embodiment of a lighting unit, which differs from the first embodiment of a lighting unit 10 only in that the main light source 18 is an arc discharge lamp. By using a suitable reflector (not shown), the resulting light emission 22 is made especially narrow.

In the further example of FIG. 6, a third embodiment of a lighting unit is shown, where the main light source 18 is comprised of a plurality of LED light sources. Individual lenses at each of the LEDs form light emission 22 such that a relatively broad, substantially parallel beam is formed.

It should further be noted that in the example of FIG. 1, the movement of the lighting unit is shown only as rotation around one axis, namely the axis of the joint 16. Thus, movement may be described as a plane angle γ, which may be defined between the central optical axis 23 of the main light source 18 and the horizontal direction. While it is possible to provide a lighting unit 10 the direction of which is only controllable in one dimension as shown, it should be clear to the skilled person that the underlying concept of course extends to multi-dimensional movement, such that directions may then be defined by solid angles rather than plane angles. This of course also applies to the arrangement of auxiliary light sources 20*a*, 20*b* relative to each other (angle between optical axis 26*a*, 26*b*) as well as relative to the central optical axis 23.

Figure 2:
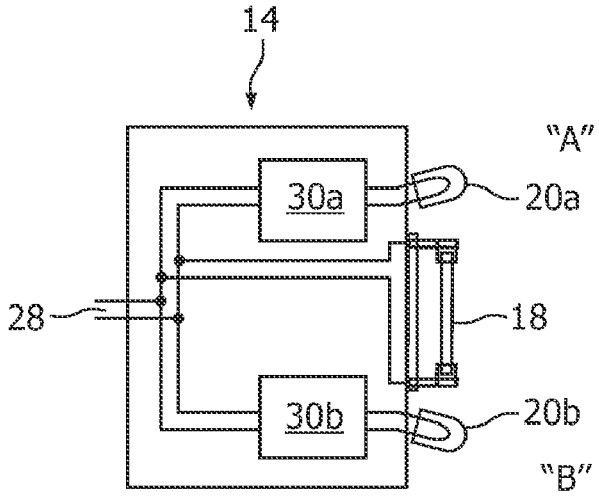
FIG. 2 shows a schematical representation of the electrical connection of the lighting unit of FIG. 1.

FIG. 2 shows a simplified schematical diagram of the fixture 14 with auxiliary light sources 20*a*, 20*b* and main light source 18. An electrical connection 28 is provided to supply electrical energy for all three light sources 18, 20*a*, 20*b*. However, while main light source 18 is operated permanently, auxiliary light sources 20*a*, 20*b* are operated by modulation driver circuits 30*a*, 30*b* to emit modulated light.

The modulation may be a simple on/off control of the modulated light sources 20*a*, 20*b*. Due to a possible rapid switching, LEDs are well suited for such modulation.

The modulation is effected in a way such that it is not perceivable by the human eye due to sufficiently high frequency. The human visual system acts as an integrator over time, such that in continuous switching at high frequency very short "off" durations will not be noticed, and longer "off" durations will be perceived as dimming the light source.

In an especially preferred example of modulation, the emitted light is modulated using a spread spectrum technique known as "code-division multiplexing access" (CDMA). The individual codes, which may here be designated "A" or "B" respectively, are orthogonal to each other, i.e. a value of an autocorrelation of a code is significantly higher than a value of a cross correlation of two different codes. Thus, a demodulator may use the predetermined codes to discriminate between simultaneous transmission of modulated light by different modulated light sources 20*a*, 20*b* Also, in a preferred embodiment the codes are constructed to be DC-free, e.g. as provided by using Walsh-Hadamard codes. Then the codes are also orthogonal to the DC-like background or non-modulated light.

Emission of modulated light, especially with CDMA codes, is explained in detail in WO2006/111930, which is incorporated herein by reference. Here, it is also explained how the codes may be used to distinguish contributions from several light sources.

The driver units 30*a*, 30*b* thus modulate the light emission 24*a*, 24*b* of the auxiliary light sources 20*a*, 20*b* such that they contain different identification codes. For example, the light 24*a* emitted by the first auxiliary light source 20*a* may contain a code "A", whereas the light 24*b* emitted from the second auxiliary light source 20*b* contains a code "B".

Use of the controllable lighting unit 10 with the described modulated light sources 20*a*, 20*b* pointing in different directions 26*a*, 26*b* will be explained with regard to FIG. 3, which shows a lighting system 40, e.g. in in a room, with multiple light sources. A conventional, fixed light source 42 is provided, e.g. mounted at the ceiling of a room. Further, the controllable lighting unit 10 is also mounted there. The lighting unit 10 is connected to a control unit 44 such that the control unit 44 may control the direction of the light emission, which in the example as explained above may be described by the angle γ.

An optical sensor 46 is arranged within the area that may be illuminated by the lighting unit 10. The optical sensor 46 is connected to the control unit 44.

Figure 4:
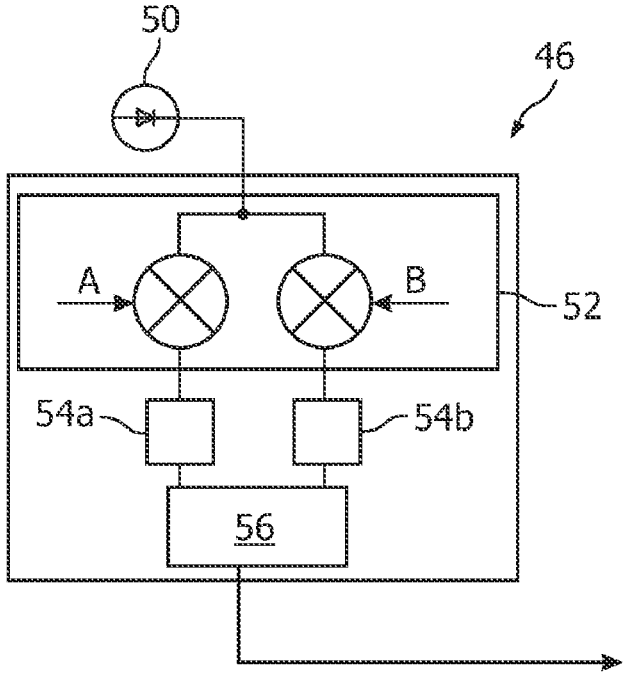
FIG. 4 shows in schematic form an optical sensor of the system of FIG. 3.

FIG. 4 shows the optical sensor 46 in schematic form. The optical sensor 46 comprises a photosensitive element 50 which receives incident light and produces a corresponding electrical signal. The electrical signal provided by photosensitive element 50 is demodulated by a demodulation unit 52 to extract those portions of light incident on the photosensitive element 50 that are modulated according to codes "A" and "B". The modulation unit 52 delivers the correspondingly demodulated portions of the signal to measuring devices 54*a*, 54*b* which deliver a value representative of the intensity of the received light portion modulated with codes "A", and "B", respectively. Information about the received intensities is passed to an interface unit 56 and delivered to the control unit 44.

Figure 3:
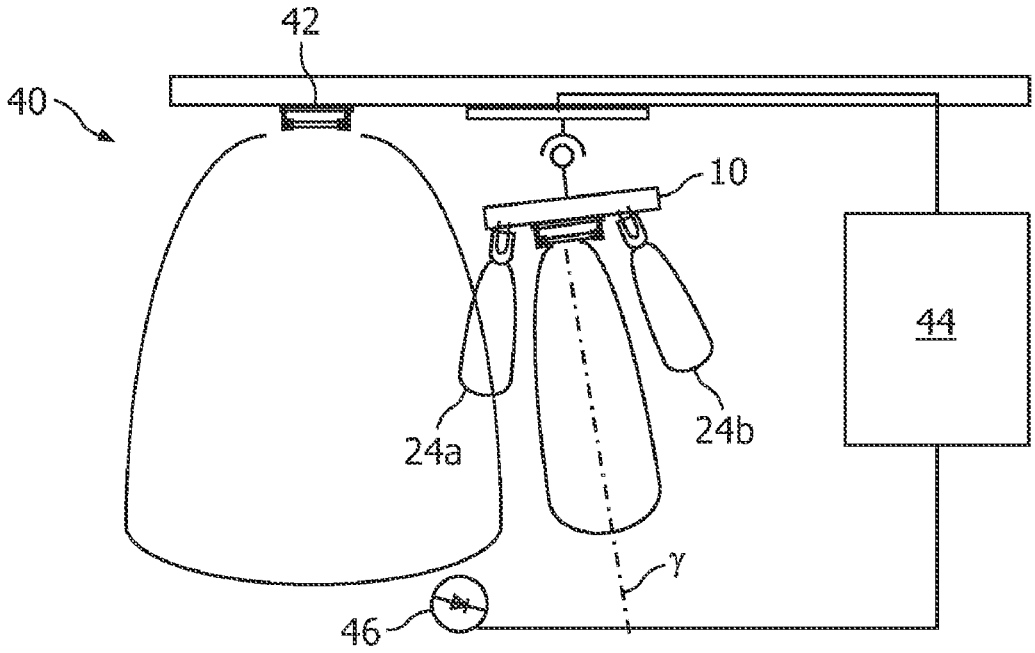
FIG. 3 shows a lighting system comprising a direction controllable light as shown in FIG. 1.

Thus, while the optical sensor 46 in the lighting system 40 of FIG. 3 receives light both from the fixed lighting unit 42 and the controllable lighting unit 10, and there from both auxiliary light sources 20*a*, 20*b* and the main light source 18, the signal passed on to control unit 44 only comprises information about the received intensities of the modulated light emission 24*a*, 24*b* from the controllable lighting unit 10.

This allows control unit 44 to control the direction of lighting unit 10. For example, it may be desired to direct lighting unit 10 to point to the location of optical sensor 46. With the position of lighting unit 10 as indicated in FIG. 3, it is clear that the lighting unit is directed too far to the right. This leads to a relatively strong incident light 24*a* from the first auxiliary light source 20*a*, which is modulated according to code "A", whereas no or only a small signal modulated with code "B" is received from the second auxiliary lighting unit 20*b*. From this information, transmitted to the control unit 44, the unit may determine that the lighting unit 10 is directed too far to the right. A quotient of the received intensities may even yield a certain measure of the angular value of misalignment.

The control unit 44 thus send corresponding control commands to the motor joint 16 to move lighting unit 10 a certain distance to the left. Then, a further measurement of intensities of the modulated light portions is effected by optical sensor 46, such that the control unit 44 receives information indicating if the alignment is now correct (same intensity of light emissions 24*a*, 24*b* received), or if a further correction to the left (emission 24*a* stronger) or even to the right (emission 24*b* stronger) is necessary. The control unit 44 may thus employ a closed-loop control to direct lighting unit 10 exactly such that its main optical axis 23 is directed to the place of the optical sensor 46.

While in the forgoing embodiments lighting units where shown to be direction adjustable by a mechanically moveable fixture 14, it is also possible to achieve directional control of the light emission of a lighting unit in different ways, as will next be explained with reference to FIGS. 7*a*-7*c*. It should be noted that while the examples described and shown in FIGS. 1, 3, 5 and 6 may refer to a motor joint as means for controlling direction, this is given as an example only and should not be construed as limiting. Instead, it is possible to exchange the shown and described lighting units with a motor joint by alternative lighting units as will next be described.

Figure 7A:
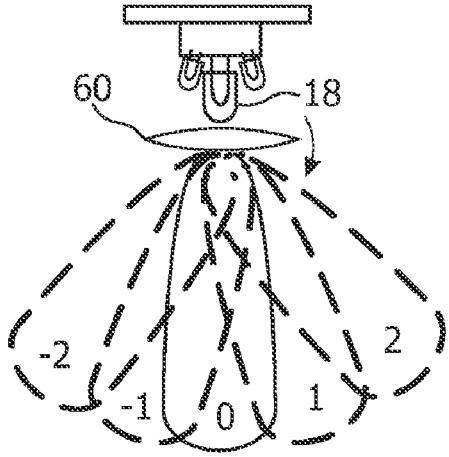
FIGS. 7*a*-7*c* show different embodiments of direction controllable lamps.

As shown in FIG. 7*a*, direction of the light emission into different directions (designated here −2 . . . 2) may be achieved by mechanical movements, e.g. rotation, of an optical device positioned in the beam path of a light source 18 (in this case shown to be an LED, but the light source 18 could, of course, be of any other type). The optical device may be e.g. a lens, or a diffuser, and may be moved e.g. by a motor. The position of the optical device controls the direction of the light emission. As in the above described case of mechanical movement of the fixture 14, not only rotation in the shown plane, but also around a perpendicular axis is possible.

Figure 7B:
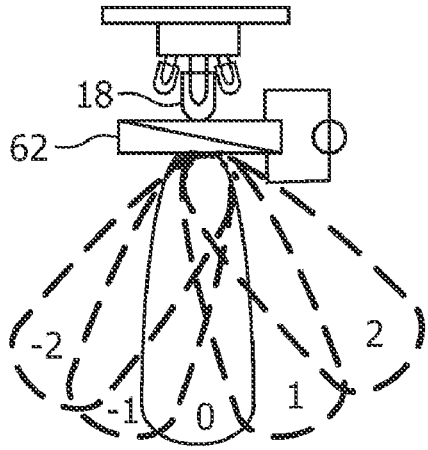

Further, as shown in FIG. 7*b*, direction of the light output of light source 18 may be achieved by positioning a voltage sensitive optical device 62 in the beam path. By applying an external electrical signal to the voltage sensitive optical device 62, the light emission may be directed. In a preferred embodiment, the device 62 is an electro-optical device such as a Liquid Crystal Lens, e.g. as explained in WO2005/12164 A1.

Figure 7C:
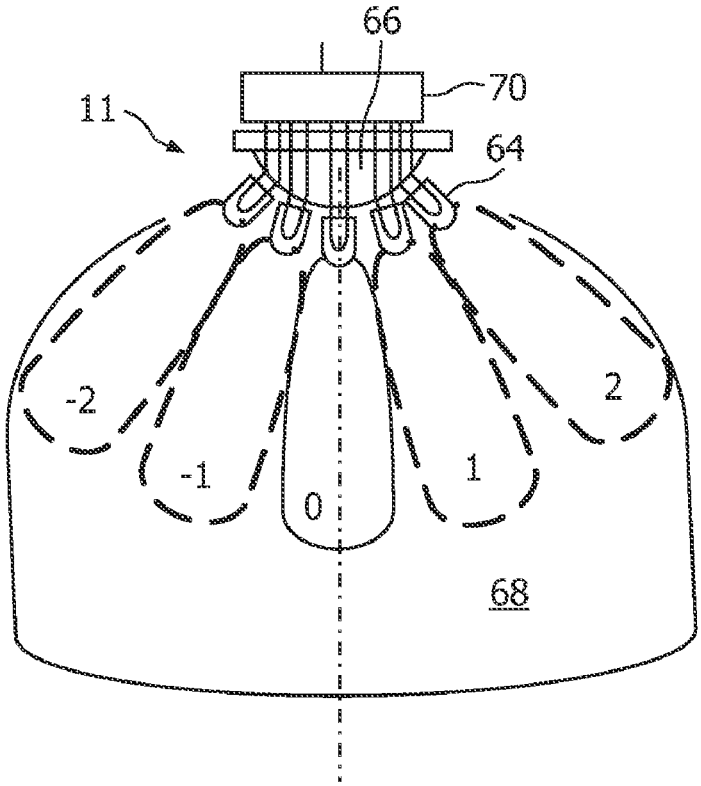

In a yet further embodiment shown in FIG. 7*c*, the lighting unit 10 comprises a plurality of individually controllable light sources 64 mounted on a common body 66 such that they emit a directed light emission into different directions. The whole range of possible light emissions from lighting unit 11 is designated in FIG. 7*c* as beam pattern 68, and is made up by bordering light emissions from the individual light sources 64. Alternatively, the light emissions may also be overlapping.

A control circuit 70 is provided which receives input commands for a desired intensity and direction of the light emission from lighting unit 11 and drives the individual light sources 64 to achieve, as a resulting sum output, the desired emission. This is achieved without mechanical movement of any part of lighting unit 11. For example, if emission only in direction 0 is desired, the control device 70 may control the light sources 64 such that they are all switched off, except for the central light source pointing in the "0" direction. Similarly, if a beam direction of "−2" is desired, only the light source 64 to the left would be switched on. In case of desired light emission in between two directions at which light sources 64 are provided, e.g. for a light direction of "−1.5", this may be achieved by operating certain light sources 64 in a partially dimmed state, e.g. by operating the two left most LEDs at 50% light contribution.

Thus, lighting unit 11 may achieve a directed illumination within a substantial range 68 without any mechanically moving parts.

Regarding the lighting unit 11 of FIG. 7, it should be emphasized that the shown light sources 64 here (which are preferable LEDs, as shown in the figure, but may alternatively of course be other, preferable dimmable types of light sources) may constitute only the main light source 18, and further light sources (not shown) may be provided for emitting modulated light (see FIG. 1).

However, it is preferred that at least a part of the light sources 64, which are already pointed in different directions, are driven to emit modulated light as explained in relation to a first embodiment. At least two of the lighting units, e.g. those directed as "−2" and "2", or even all of the light sources 64 may emit modulated light, such that the optical receiver 46 may gather from demodulation of the observed light information about which of the light sources 64 illuminates it.

Figure 8:
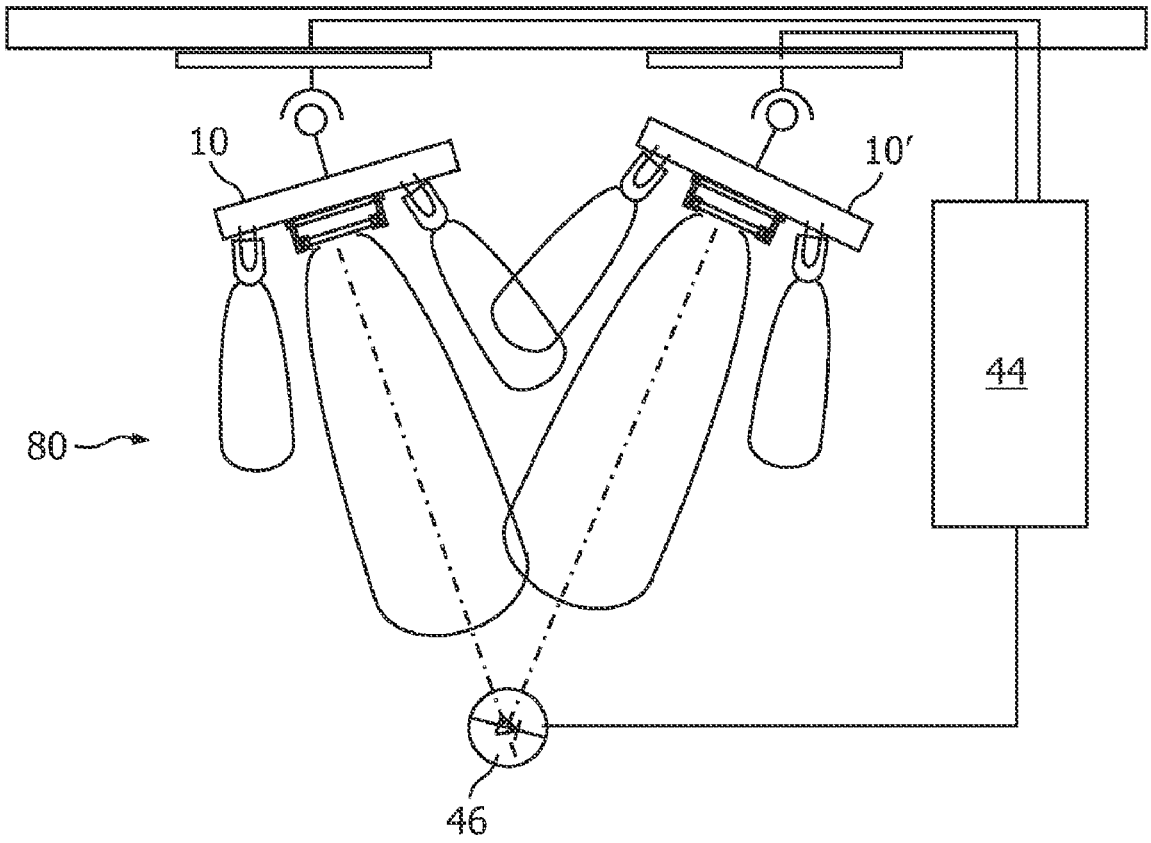
FIG. 8 shows a further embodiment of a lighting system comprising multiple direction controllable lamps.

FIG. 8 shows a further lighting system 80 to illustrate in an example how multiple direction controllable lighting units 10, 10' may be controlled. It should be noted that the shown type of direction controllable lighting units 10, 10', which are controllable by motor joints and have a halogen lamp as main light source are given as an example only, and of course could be replaced by any of the further described lighting units, methods of controlling direction and types of light sources.

In the case of multiple direction controllable lighting units as shown in the lighting system 80 of FIG. 8, the embedded codes in the light emission of the auxiliary light sources are unique. Thus, e.g. the auxiliary light source to the left of the first direction controllable lighting unit 10 may be distinguished by its embedded code not only from the auxiliary light source of the same lighting unit, but also from all other auxiliary light sources of other lighting units.

The user, who wants to control the lighting system 80, proceeds as follows:

First, the directional lighting unit of which the direction is to be controlled first is identified. This could be done e.g. by holding the optical sensor device 46 close to the lighting unit, so that the sensor 46 now identifies the codes emitted to identify the lighting unit. Another method could be by use of a user interface device which identifies the controllable lighting devices. A selected lighting unit may start flashing, so that the user can identify the presently selected lighting unit.

After the selection is effected, the sensor device 46 is placed at a location where the emitted light from the directional light source is supposed to be targeted. The user then initiates automatic control, so that control unit 44 adjusts the selected lighting unit 10 to point to this location.

Control is effected as described above by measuring the light contribution of the individually coded light emissions received at the sensor device 46 and communicating the demodulated information to the control unit 44.

The information is evaluated according to an evaluation criteria. This criteria may be the highest illumination contribution of the lighting unit, or another criteria, such as an equal illumination contribution of the two modulated light sources. If direction of the lighting unit 10 is found to be already satisfactory, the procedure is ended. If not, a new direction of the lighting unit 10 is calculated by a control algorithm based on the current measurement, or together with a set of previous measurements. This direction is communicated to the direction controllable lighting unit 10, so that the lighting unit 10 changes its emission direction based on the communicated control data (which change could be effected, e.g., according to one of the embodiments shown in FIGS. 1, 7*a*, 7*b*, 7*c* described above).

The measurement and adjustment steps described above are repeated until a satisfactory result is achieved.

Within control unit 44, control is thus effected according to a control algorithm which yields in each step the new direction of the lighting unit 10. An example of a control algorithm could be to try a discrete set of possible directions and chose the one with the highest score according to the evaluation criteria. Other methods could be based on adaptive filtering (LMS, RLS algorithms) or other optimization techniques known per se to the skilled person.

After direction of the first lighting unit 10 has thus been adjusted, the user may now proceed to adjust direction of a second controllable lighting unit 10'. This lighting unit may be directed to the same location, or the optical sensor 46 may be moved to direct the second lighting unit 10' to a different location.

Alternatively, it is also possible to simultaneously control both (or in the case of further available lighting units: all, or at least a subset) of the direction controllable lighting units in the lighting system 80, such that they are all directed to the location of the optical sensor 46.

While in the above described examples directional control is only effected in a 2D plane, the concept of course also applies to 3 dimensions.

The invention has been illustrated and described in detail in the drawings and foregoing description. Such illustration and description are to be considered illustrative or exemplary and not restrictive; the invention is not limited to the disclosed embodiments.

There are a plurality of further features possible, such as

Alignment of Spots with Offset to the Sensor

In the above examples it was shown how the lighting units could be controlled to point directly to the sensor 46. It should be noted that it is of course also possible to automatically obtain a lighting direction with a predetermined—fixed or variably chosen—offset angle. E. g. the operator could choose to adjust a spot such that it should point a predetermined angle, say 10°, above the position of the sensor 46.

Times at which Codes are Transmitted

In the foregoing text, the lighting units and light sources have been described with relation to their special feature of emitting modulated light to facilitate control. Of course, it is still the main purpose of the lighting units to provide the desired illumination for lighting. Thus, after control has successfully been effected, the light sources described above as modulated light sources may continue to emit modulated light (which should be modulated in a way that modulation is not perceived by the human eye), but could also be operated continuously.

In fact, in a system with a plurality of lighting units, the light sources of each lighting unit may be operated in a way such that they emit modulated light only if their lighting unit is specifically selected for control. Thus, an operator could select a limited number, or even only one lighting unit for control. The control unit would then assign codes to the light sources of the selected lighting unit(s). This would greatly facilitate handling of codes, because for effective control the codes need to be unique. If codes are consequently only used when specifically needed, a limited number of codes may suffice. It is even possible that in each of a plurality of lighting units the light sources have the same code, if it is ensured that they are not operated (controlled) simultaneously.

Additional Control of Intensity and Color

By the techniques of this invention, it may also be possible to control, in addition to the direction of lighting units, intensity and/or color of the light emission. This could be done manually at a user interface, e.g. located at the sensor device 46, or by an automatic control effected through control unit 44. Here also, the codes in the light may be used to distinguish the individual contribution of specific light sources.

Position Information of a Sensor

As a further idea, if the direction of light emission of a lighting unit 10 is known, the information provided by the modulated light may be used for deriving at least an approximate position of the sensor device 46. The power of the light contribution of the different (directional) light sources forms a measure for the location of the sensor device 46 if the orientation of the direction controllable lighting unit is known.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A controllable lighting system, comprising:

at least one direction controllable lighting unit, comprising:

means for directing a light emission into different directions, a plurality of light sources mounted on a common body, said light sources disposed to emit directed light emissions differing in at least one of shape, direction or position, and coding means to drive said light sources such that said light emissions are modulated to contain an identification code (A,B), wherein said codes of said light sources are different;

an optical sensor suited to be arranged in a region illuminated by said lighting unit, where said optical sensor comprises demodulation means to demodulate said indentification codes (A,B), and a control means connected to said optical sensor and to said lighting unit, where said control mean is disposed to control the direction of a light emission of said lighting unit based on information about said demodulated code.

2. The system according to claim 1, wherein said direction of said lighting unit is controlled by determining a relative positioning of the light emission direction of said lighting unit and said optical sensor, and wherein said relative positioning is determined by identifying said identification code (A, B).

3. The system according to claim 1, wherein said sensor is disposed to provide a measurement of intensity of said light modulated with said identification code, and said relative positioning is determined by identifying by said identification code and said measurement of intensity from which of said more light coming from light sources is received.

4. The system according to claim 1, wherein said control means is disposed to control the direction of said lighting unit by at least one iteration of a closed-loop operation, where in each iteration said lighting unit is driven to change the direction of its light emission, and then said optical sensor is operated to obtain information about said identification codes in the received light, and said information is evaluated according to an evaluation criteria.

5. The system according to claim 1, said system comprising multiple direction controllable lighting units, wherein each light source of said lighting units emits light modulated to contain a unique identification code.

* * * * *